US007025229B2

(12) United States Patent
Bochno et al.

(10) Patent No.: US 7,025,229 B2
(45) Date of Patent: Apr. 11, 2006

(54) ASSEMBLY OF PACKAGE AND APPARATUS FOR THE METERED EMPTYING OF THE PACKAGE AS WELL AS APPARATUS THEREFOR

(75) Inventors: Victor Robert Bochno, Valkenswaard (NL); Cornelis Willem Blom, Sassenheim (NL)

(73) Assignee: Intercon Holland B.V., (NL)

( * ) Notice: Subject to any disclaimer, the term of this patent is extended or adjusted under 35 U.S.C. 154(b) by 248 days.

(21) Appl. No.: 10/639,420

(22) Filed: Aug. 11, 2003

(65) Prior Publication Data

US 2004/0104248 A1 Jun. 3, 2004

(30) Foreign Application Priority Data

Aug. 9, 2002 (NL) ..... 1021247

(51) Int. Cl.
*B65D 35/28* (2006.01)

(52) U.S. Cl. ..... 222/94; 222/95; 222/105; 222/107; 222/136; 222/541.6

(58) Field of Classification Search ..... 222/92, 222/94, 95, 101, 103, 105, 107, 136, 541.1, 222/541.6

See application file for complete search history.

(56) References Cited

U.S. PATENT DOCUMENTS

| | | | | |
|---|---|---|---|---|
| 2,795,356 | A * | 6/1957 | Tschumy | 222/105 |
| 3,993,220 | A * | 11/1976 | Troy | 222/105 |
| 4,010,873 | A * | 3/1977 | Mardirossian | 222/101 |
| 4,270,672 | A * | 6/1981 | Kraals | 222/95 |
| 5,035,347 | A * | 7/1991 | Trovo | 222/95 |
| 5,810,205 | A * | 9/1998 | Kohen | 222/105 |
| 6,401,978 | B1 * | 6/2002 | Young | 222/101 |

FOREIGN PATENT DOCUMENTS

WO WO 200142100 A1 * 6/2001

* cited by examiner

*Primary Examiner*—Eric Keasel
(74) *Attorney, Agent, or Firm*—Varnum Riddering Schmidt Howlett, LLP

(57) ABSTRACT

An assembly of a package that includes a flexible sheet-like foil material containing a viscous material, with apparatus for metered emptying of the package. The apparatus includes a frame, a guide, and a substantially flat two-part supporting surface. A metering control is movable along the supporting surface. The guide holds the metering control in a substantially fixed orientation relative to the supporting surface. The metering control empties the package by nip-wise pressing the package flat onto the supporting surface. The frame includes a stationary part and a movable part, which parts form a continuous, uninterrupted supporting surface in a first position and which parts close off an open package by squeezing it shut in a second position.

24 Claims, 2 Drawing Sheets

ASSEMBLY OF PACKAGE AND APPARATUS FOR THE METERED EMPTYING OF THE PACKAGE AS WELL AS APPARATUS THEREFOR

This invention relates to an assembly provided with a package and an apparatus for the metered emptying of the package, which package contains viscous material and is at least partly manufactured from flexible sheet-like foil material, and which apparatus is provided with a frame with guide means and a substantially flat supporting surface for supporting the package, as well as with metering control means which, guided by the guiding means, can be moved, in a position substantially not changing as regards their orientation relative to the supporting surface, over and along the supporting surface, the emptying taking place by nipwise squeezing the package flat onto the supporting surface with the metering control means, starting from a first end in the direction of a second end, located opposite the first end, having at least one dispense opening to be opened by cutting away material of the package, the at least one dispense opening being situated on the supporting surface, and the metering control means being movable over the supporting surface at least as far as the at least one dispense opening, as well as to an apparatus suitable for use in such an assembly.

An assembly as referred to in the preceding paragraph is known from WO 01/42100. Such an assembly has a series of advantages. First of all, the package, due to its being manufactured from flexible material and due to the dispense opening being situated on the supporting surface, can be emptied completely. This does not only mean that the utilization of all the material present in the package is as complete as possible, but it also constitutes an environmentally friendly solution, because material remaining in such a package must often be regarded as chemical waste, with all the attendant consequences in the processing of packages that cannot be emptied completely or substantially completely, as is the case, for instance, with the conventional filling cartridges for metering guns. Also, the apparatus, certainly when compared to the conventional metering guns, is of simple construction, without this entailing loss of metering accuracy. On the contrary, in fact, while material contained in the package is being pressed out of the package, less pressure is built up in that package than with a metering gun, so that upon termination of the metering operation the trailing amount of material pressed out of the package is minimal.

If a package contains more than one component, which components are accommodated in adjacent compartments and are to be mixed after being pressing out of the package, such an assembly ensures that the components are pressed out in the proper amounts as regards their mixing ratio, if the compartments, as to their passages, are tailored to that mixing ratio. This effect is achieved by nipwise squeezing the package transversely to the package, so that the compartments are emptied proportionally and the components are dispensed in the desired mutual mixing ratio.

A package will often not be emptied wholly in one go. In that case, it may be desirable to temporarily close the dispense opening or, in case of several components, the dispense openings. This can be realized with a clamp squeezing the dispense opening shut onto the supporting surface. This, however, is less convenient, for one thing because a loose clamp may get lost, is complicated to fit, and fitting it near the dispense opening may give rise to the fingers getting soiled.

One object of the invention is to enable the closure of an opened and partly emptied package to be carried out rapidly and readily, a further object being the integration of the closure in an overall concept enabling working with such an assembly in an optimal manner.

This is achieved according to the invention with an assembly of the type described in the opening paragraph if the frame comprises a stationary part having a first supporting surface part and a part movable relative to the stationary part, having a second supporting surface part, wherein in a first position, in which the movable part is coupled with the stationary part, the second supporting surface part is in line with and contiguous to the first supporting surface part and carries a part of the package including the at least one dispense opening, while in a second position, in which the movable part is also coupled with the stationary part, the second supporting surface part is offset relative to the first supporting surface part, the arrangement being such that in the second position, through a cooperation, secured against movement, of the stationary part and the movable part, the package is substantially sealingly closed off in the vicinity of the at least one dispense opening. Through these measures, in a simple manner, through a particular construction of the supporting surface, more in particular a two-part construction, the closure of an opened and partly emptied package can be realized with a part already present to enable the emptying of the package in the desired advantageous manner. Because the package is pressed together in the vicinity of the at least one dispense opening to obtain the closing effect and this part of the package is to be supported by the first supporting surface part to effect the squeezing in cooperation with the second supporting surface part, the second supporting surface part will mostly be relatively small in comparison with the first supporting surface part. A material-containing compartment of the package will preferably terminate in a spout part which, upon opening of the package, for instance by cutting away a strip therefrom, results in an opening with a passage smaller than the passage of the contiguous compartment. In such a case, the part of the package located on the second supporting surface part in the first position of the supporting surface parts can be substantially that spout part.

Squeezing a dispense opening shut by displacing the movable part can be realized in many ways. Thus, the movable part may be pressed in a more or lesser inclined position against the end edge of the stationary part, with the package being clamped therebetween. According to a further embodiment of the invention, however, it is preferred that the second supporting surface part in the second position extends substantially parallel to the first supporting surface part. In this manner, a surface-to-surface pressure plane between the first and the second supporting surface part, and thus a particularly effective closure of the package, can be realized.

Bringing the second supporting surface part from the first into the second position and securing it in that position can be realized in many ways, in which connection sliding and snapping movements may be considered. This operation can be effected in a particularly ready and simple manner if, according to a further embodiment of the invention, the movable part can be brought from the first position into the second position by pivoting relative to the stationary part, the arrangement being such that in the second position the second supporting surface part is directed substantially opposite to the first supporting surface part. If, furthermore, in the second position a free end edge of the movable part leading in the first position lies against an end edge of the stationary part leading both in the first and in the second position, thereby squeezing a part of the package shut, then the closure is, in fact, realized in a simple manner by pivoting the second supporting surface part from the underside of the package along the front thereof onto the package, after which, through cooperation with the first supporting surface part, the closure is effected, whereby the squeezing area can obtain the depth considered optimal if an edge area of the second supporting surface part on the movable part in the second position is situated opposite an edge area of the first supporting surface on the stationary part. By allowing the two edge areas to overlap to a greater or lesser extent, the desired overlapping depth and hence sealing depth is adjustable.

If, when the movable part is of pivoting design, according to a further embodiment of the invention, the movable part forms part of a cover part and the stationary part forms part of a bottom part, while the cover part and the bottom part in the second position of the supporting surface parts form a closed box in which the package is contained, then, on the one hand, the closure of an opened package can be realized in a rapid and convenient manner and, on the other hand, a storage box is obtained which enables an opened or unopened box to be transported as well as stored whilst protected from ambient influences. Further, such a box can be made of stackable design and, compared to a package for a conventional metering gun, occupies only relatively little space. Also, such a box is easy for a private user to take away and to store, for instance to and in his house, boat, trailer or tent, because the package, opened or not, is safely stored in the box whilst protected from weather influences and splash water, the more so if, according to a further embodiment of the invention, on the first supporting surface part, on a side remote from the second supporting surface part, viewed in the first position of the supporting surface parts, fixing means are provided for fixing the package relative to the first supporting surface part.

Forming the second supporting surface part on the movable cover part can be utilized for obtaining a further advantage. For if, according to a further embodiment of the invention, viewed in the first position of the supporting surface parts, the cover part, contiguous to a side of the second supporting surface part remote from the first supporting surface part, forms a mixing part for material pressed out of the package, while the cover part in that position can be uncoupled from the bottom part, an auxiliary tool has been obtained in a highly convenient manner, which can carry an amount of material pressed out of the package and which can be handled independently of the package and the metering control means when applying the pressed-out material at the desired location. Certainly if the package contains more than one component, this auxiliary tool forms an optimum mixing tray.

For ready but reliable realization of the properly controlled and metered pressing of material to be used out of the package, it may be provided, according to a further embodiment of the invention, that the guide means, viewed in the first position of the supporting surface parts, have the form of raised side edges located in line with each other on both sides of the first and the second supporting surface part, and the metering control means have the form of a spatula-like member having such a width that the spatula-like member can be slid between the raised side edges with a sliding fit.

The invention also relates to an apparatus which is to be used in such an assembly. To this end, in an apparatus for the metered emptying of a package containing viscous material and at least partly manufactured from flexible sheet-like foil material, which apparatus is provided with a frame with guide means and a substantially flat supporting surface as well as with metering control means, the metering control means and the guide means being arranged such that the metering control means can be moved, in a position not changing as regards their orientation relative to the supporting surface, over and along the supporting surface, as known from WO 01/42100, it is proposed, according to the invention, that the frame comprises a stationary part with a first supporting surface part and a part movable with respect to the stationary part, having a second supporting surface part, the second supporting surface part, in a first position in which the movable part is coupled with the stationary part, being in line with and contiguous to the first supporting surface part, while in a second position in which the movable part is also coupled with the stationary part, the second supporting surface part, while leaving clear a relatively narrow slit in the order of the thickness of two layers of flexible sheet-like foil material, is offset and secured with respect to the first supporting surface part. The relatively narrow slit may be located on, before or below the first supporting surface part, depending on the manner in which the movable part is situated relative to the stationary part in the second position of the supporting surface parts.

Of importance is that the package can be clamped in such a manner that each dispense opening is squeezed shut in a sealing fashion. The part of the package that with respect to the part of the package closed after squeezing is located on the other side of the closing area should preferably not contain material, more in particular not if this hardens by contact with air. The part of the package referred to above, of course, can be pressed out separately after a specific amount of material has been pressed out of the package, but here, too, it is preferred that the amount be kept as small as possible. This can be realized by keeping the surface of the second supporting surface part relatively small with respect to the first supporting surface part and by having the package for the most part supported by the first supporting surface part, so that only the dispense opening and the part of the package located in the immediate vicinity thereof are located on the second supporting surface part. In that case, certainly if it is considered that the dispense opening will often be the end of a spout-like passage narrowed with respect to a compartment of the package, at most only a relatively minor part of the opened package will be located beyond the closing area.

A particularly advantageous embodiment is obtained if, according to a further elaboration of the invention, the stationary part is accommodated in a bottom part and the movable part in a cover part, while the bottom part and the cover part can be assembled to form a closed box in which the two supporting surface parts are in the second position, while in an opened position of the box the bottom part and the cover part can be brought into a coupled position such that the two supporting surface parts are in the first position. In such an embodiment, by simply opening and closing the box, the apparatus can be brought into its condition of use or its storage or transport position.

The mutual position of the stationary part and the movable part in the second position of the supporting surface parts can be easily realized and arrested if, according to a further embodiment of the invention, the second supporting surface part is provided on an end of the cover part which, at least in the closed position of the box, is connected by means of a hinge connection with an end of the bottom part, while it is further preferred that in the closed position of the box the ends of the bottom part and the cover located opposite the hingedly connected ends of those parts are connected by a childproof closure.

If according to a further embodiment of the invention the hinge connection is formed by journals on one part and recesses receiving them in the other part, the arrangement being such that in the open position of the box the hinge connection can be undone, then, after conveniently and simply pressing material to be used out of the package as far as at least onto the second supporting surface part, that is to say as far as onto the cover part, this can be handled independently of the bottom part, which considerably promotes handling freedom when processing the material pressed out of the package.

Both the securing in the second position of the supporting surface parts and the uncoupling possibility in the first position while retaining an uninterrupted continuous two-part supporting surface can be realized according to a further embodiment of the invention in a relatively simple manner if the cover part, on both sides of the second supporting surface part, is provided with side wall flanges extending perpendicularly to the second supporting surface part and the bottom part is provided with side wall parts extending in line with the first supporting surface part and perpendicularly thereto, the side wall flanges being provided with the recesses mentioned and the side wall parts being provided with the journals mentioned, the arrangement being such that in the second position of the supporting surface parts the side wall flanges and the side wall parts are located face-to-face next to each other and the journals sit in the recesses, while in the first position of the supporting surface parts the journals are detachably located in the recesses, for instance by making the side wall parts of flexible design.

A particularly convenient further elaboration in which the coupling between the movable part and the stationary part can be maintained while at the same time the uncoupling is already prepared, is obtained if according to a further embodiment of the invention the side wall flanges are each provided with a recess in the form of half a slotted-hole opening with open outer end and a semi-circular inner end, the arrangement being such that the journals in the first position of the supporting surface part can slide into and out of the open outer end and in the second position of the supporting surface parts butt against the semi-circular inner end. Through these measures, the sliding apart of the first and the second supporting surface part in their plane is prevented by the journals sitting in the half slotted-hole openings, whilst a displacement perpendicular thereto is not impeded. Thus, while the material is being pressed out of the package, the two supporting surface parts remain in mutual abutment, while after the pressing out the cover part is uncoupled from the bottom part by a pick-up movement.

In order that, after the processing of material pressed out of the package, the coupling between the cover part and the bottom part for the purpose of closing the open, partly emptied package is facilitated, it is preferred, according to a further embodiment of the invention, that each side wall flange, starting from the semi-circular inner end of the half slotted-hole opening, in a direction away from the open inner end of the half slotted-hole opening, is provided with a snap-in recess. The cover part can then be readily and rapidly snapped on the bottom part.

Material pressed out of the package often needs to be kneaded and, in particular if the package contains several components, mixed. The operations to be carried out to that end can be carried out efficiently if, according to a further embodiment of the invention, the cover part, viewed in the first position of the supporting surface parts, contiguous to the second supporting surface part, has the form of an open tray. The material pressed and slid out of the package over the second supporting surface part then ends up directly in the open tray and can be processed therein. It should be borne in mind here that in a number of applications additives are added to the material pressed out of the package, such as colorants and solid particles, for instance for obtaining a marble effect. For these operations, too, the open tray is advantageous, certainly if, as described above, it can be uncoupled from the bottom part.

To be able to hold the open tray firmly without the risk of soiling the fingers, it is preferred, according to a further embodiment of the invention, that the open tray is divided by a partition into two compartments, one compartment, connecting to the second supporting surface part, serving for processing the material and the other compartment remaining free from this material, so that fingers extending into it remain free from soiling.

For kneading or mixing the material, use can be made of a spatula, which can also be used for applying the material at the desired place and finishing it. If, according to a further embodiment of the invention, the first supporting surface part is situated on an intermediate part accommodated in the bottom part, a storage space for such a spatula is advantageously created in the box. Of course, that storage space may also be used for storing other articles, such as a modeling knife, a cleaning cloth, an instruction booklet, additives to be added to the material, etc.

When using a supporting surface consisting of two parts, the accurately metered and measured pressing of material out of the package can be realized in a simple, rapid and reliable manner if, according to a further embodiment of the invention, the first supporting surface part, is provided on both sides with side edges extending perpendicular thereto, which can serve as guide means and, in the first position of the supporting surface parts, are in line with side wall flanges arranged on both sides of the second supporting surface part, while, further, metering control means are provided in the form of a spatula-like member having a width substantially equal to the distance between the side edges on opposite sides of the first supporting surface part, and which is provided with a rounded bent emptying edge having on both sides guide surfaces extending perpendicular thereto.

An apparatus as the present one is not thrown away together with an empty package, but can be reused by replacing an empty package with a new, full package, which may have the same content as the previous package, but may also have a different content. To hold such a package whilst correctly situated on and in the apparatus, it may be provided, according to a further embodiment of the invention, that on the first supporting surface part, in an end area remote from an area contiguous to the second supporting surface part in the first position of the supporting surface parts, fixing means for a package are provided. The fixing means may consist of a clamping strip or clamping slot, but in a further embodiment of the invention it is preferred that the fixing means are formed by hooking lugs with a hooking direction substantially parallel to the first supporting surface part, which hooking lugs are suitable for cooperating with openings provided in a package.

With reference to exemplary embodiments shown in the drawing, the assembly according to the invention will now be explained in more detail. In the drawing.

Figure 5:
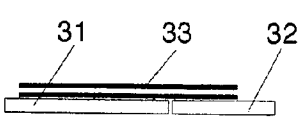

FIG. 5 diagrammatically shows a divided supporting surface with an opened package lying thereon; and FIGS. 6–10 show different possibilities for closing an opened package using the divided supporting surface.

Figure 1:
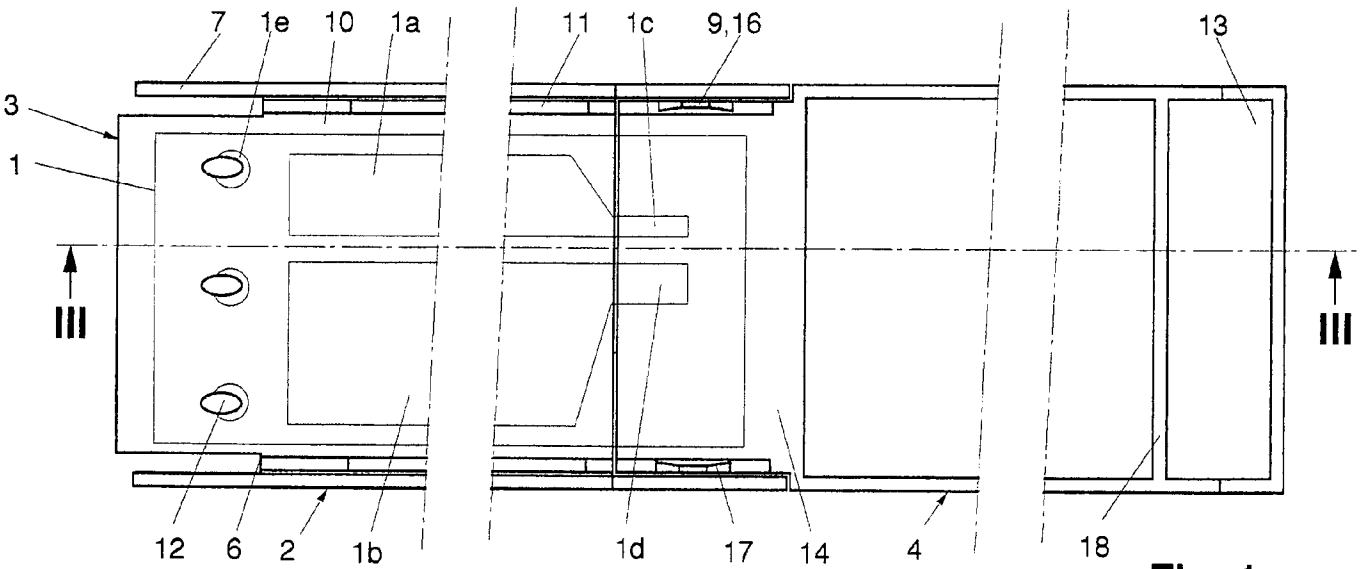
FIG. 1 shows, in top plan view, an assembly according to the invention in a position of use.
Figure 3:
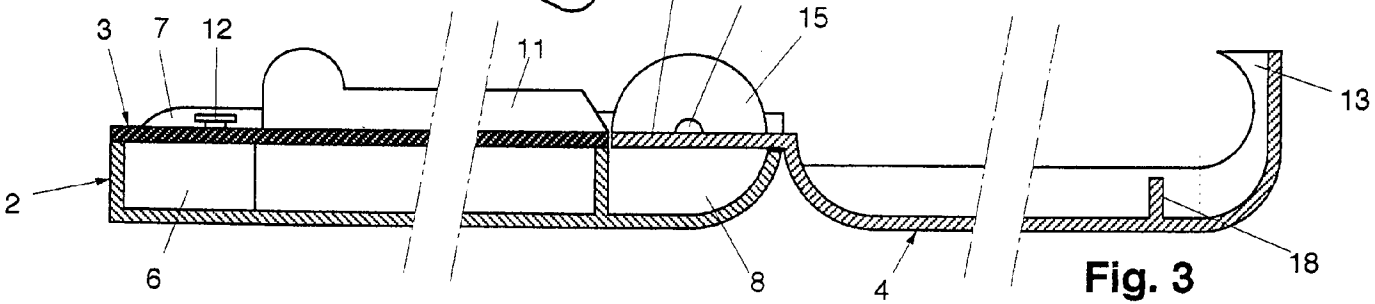
FIG. 3 shows a cross-section on the line III—III in FIG. 1.

FIGS. 1 and 3 show an assembly for the metered emptying of a package 1, represented in thin lines, which package is manufactured from two sheets of flexible plastic material, which are mutually welded together, such that two mutually separate receiving spaces 1*a* and 1*b* for viscous material are formed. The two receiving spaces 1*a* and 1*b* terminate at one end in a spout part 1*c* and 1*d*, respectively, which can each form a dispense opening by cutting away a part of the package. At the end located opposite the spout parts 1*c* and 1*d*, the package is provided outside the receiving spaces 1*a* and 1*b* with openings 1*e* for arresting the package 1 relative to an apparatus belonging to the assembly, which apparatus will be described below in more detail.

Figure 2:
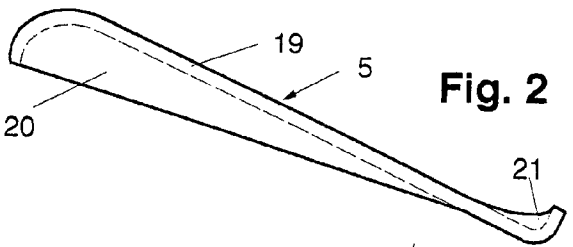
FIG. 2 shows, in side view, a spatula to be used as metering control means.

The apparatus referred to comprises a bottom part 2, an intermediate part 3 and a cover part 4, as well as a spatula 5, shown in FIG. 2, to be used as metering control means. The parts 2–4 are further shown in FIG. 4 in a form when stacked to form a box and when taken apart again.

The bottom part 2 has the form of an open tray with a narrowed end 6 at one end, which is offset inwardly on both sides, such that by extending the side walls not offset inwardly on both sides a freely projecting lip 7 is formed. The other end of the open tray forms a hinge compartment 8 with a hinge journal 9.

The intermediate part 3 is a plate-shaped part 10 with side edges 11 and lugs 12. The plate-shaped part 10 is of such dimensions that it can cover the open tray of the bottom part 2 with the exception of the hinge compartment 8, the recess of the open tray part being followed, so that the lips 7 remain free. The lugs 12 can extend through the openings 1*e* of the package 1 for arresting that package on the plate-shaped part 10.

The cover part 4 substantially has the form of an (inverted) open tray which terminates at one end in a hook part 13, the inner contour of which corresponds with the outer contour of the lips 7. The other end of the cover part 4 is extended by a plate-shaped flange 14 which on both sides carries a hinge ear 15 provided with a half slotted-hole opening 16, the inner end of which has a radius corresponding with that of the hinge journal 9. Starting from the half slotted-hole opening 16, each hinge ear 15 is provided in its outer surface with a locating surface 17. In the cover part 4, near the hook part 13, a transverse wall 18 is further present, which forms a partition in the open tray part.

The spatula 5 to be used in FIG. 2 as metering control means consists of a plate-shaped part 19 having a width equal to the distance between the side edges 11, and which is provided with oppositely bent ends, two open troughs closed at the ends being formed by providing raised side wall parts 20 and 21 between the bent ends and the other parts of the plate-shaped part 19.

FIGS. 1 and 3 show the above-discussed apparatus in the position in which material can be pressed out of the package 1 in a metered manner. To this end, the bottom part 2 and the cover part 4 are unfolded, that is, with the cover part 4 in an inverted position, so as to be in line with each other, the plate-shaped flange 14 covering the hinge compartment 8 and being disposed contiguous to and in line with the plate-shaped part 10 of the intermediate part 3 which is in its position covering the rest of the open tray of the bottom part 2. Thus, there is formed for the package 1 a supporting surface composed of a first supporting surface part formed by the upper surface of the plate-shaped part 10, and a second supporting surface part formed by the, in that position, upper surface of the plate-shaped flange 14. The coupling between the bottom part 2 and the cover part 4 is then provided by the journals 9 engaging in the half slotted-hole openings 16.

The package 1 is supported throughout its length, that is, including the spout parts 1*c* and 1*d*, by the supporting surface. After arresting the package on the supporting surface by hooking the lugs 12 through the openings 1*e*, and opening the package 1 by means of an intersecting line transverse to and through the spout parts 1*c* and 1*d*, the package can be emptied in a metered manner by means of the spatula 5. To this end, the spatula 5 is slipped by its end provided with the side wall parts 21, near the lugs 12 and outside the receiving spaces 1*a* and 1*b*, between the side edges 11 and, whilst confining the package, pressed until it stops against the plate-shaped part 10. Subsequently, the spatula 5 is pushed in the direction of the spout parts 1*c* and 1*d*. During this displacement, the spatula 5 is guided and controlled by the side edges 11 as a result of the sliding cooperation between the side edges 11 and the side wall parts 21. Consequently, the package is emptied not only very carefully, but also evenly. This advantage is particularly apparent if the package comprises several, for instance two, as in FIG. 1, separately packaged components which, after being pressed out of the package, are to be mixed in a predetermined ratio, for instance to form a hardening mixture.

If it is intended not to empty the package 1 in one go, then the emptying with the spatula 5 is stopped at the desired moment, and the spout parts 1*c* and 1*d* are emptied over at least the plate-shaped flange 14 with the spatula 5 or a stopping knife or the like. The material pressed out of the package ends up in the open tray-shaped part of the cover part 4 and can be processed therein, if necessary. To be considered here is, for instance, the mixing of different components, the addition of colorants or fillers, for instance small stones or other solid particles, to create a marble effect and the like.

Once this operation has been completed, the cover part 4 can be gripped and lifted at the hook part 13, whereby the cover part 4 comes loose from the bottom part 2 due to the journals 9 sliding out of the half slotted-hole openings 16. The tray-shaped cover part 4 containing the material to be processed can thus be brought to the place of use, without the remaining part of the apparatus, which substantially facilitates handling. The transverse wall 18 provides the advantage that the fingers holding the cover part 4 remain out of contact with the material present in the open tray.

Figure 4:
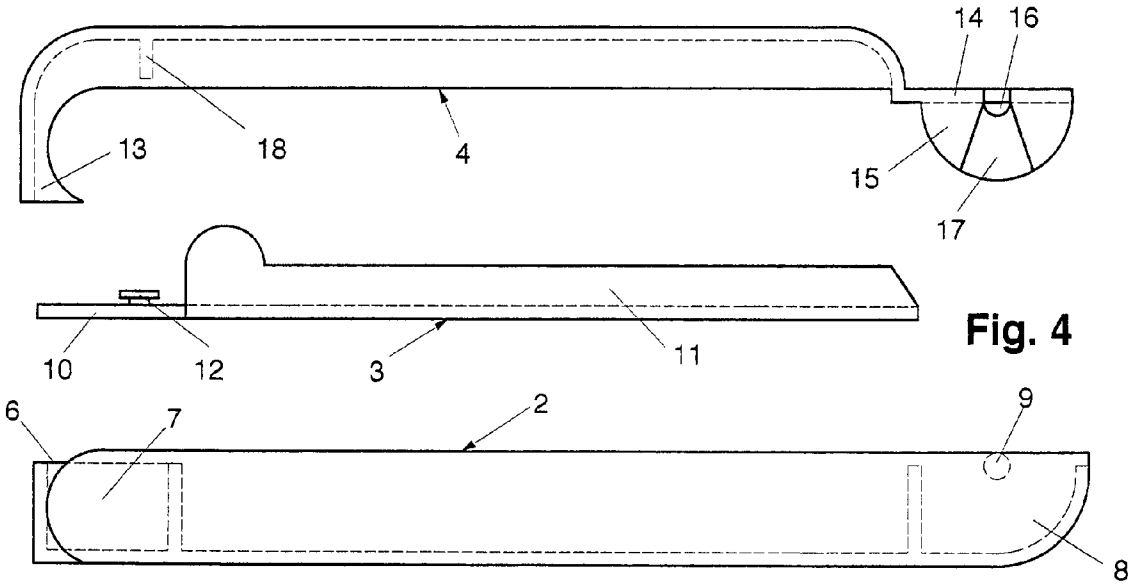
FIG. 4 shows an apparatus according to the invention in a taken-apart form.

After processing the material, the cover part is inverted, that is, brought into the position as shown in FIG. 4. If in that figure the intermediate part 3 is assumed to have been placed on the bottom part 2, as shown in FIGS. 1 and 3, the cover part 4 can be pressed on and coupled with the bottom part 2 through a downward movement. The hook parts 13 thereby snap around the lips 7 and the hinge ears 15 slide into the hinge compartment 8, while the locating surfaces 17 provide for guidance of the journals 9 towards, and their clicking into, the half slotted-hole openings 16. Simultaneously with the effectuation of this coupling, the (still partly filled) package 1, which, projecting, lies on the plate-shaped part 10, is clamped and closed by cooperation of the plate-shaped part 10 and the plate-shaped flange 14. The opened package is thus protected and secured in closed off condition, until a next use.

Before that next use, the apparatus is to be opened. This should take place by simultaneously pressing the two lips 7 inwards so far that the hook parts 13 can pass the lips 7, and the cover part 4 can be pivoted upwards about the journals 9. In closed condition, the apparatus is thus provided with a childproof closure. By swinging the cover part 4 upwards and further into the position represented in FIGS. 1 and 3, the assembly has reached its ready-for-use position again, and further material can be pressed out of the package 1 by means of the spatula 5, which can be followed by the procedure as described above.

It is further observed that the intermediate part 3 is of removable design. The space in the bottom part 2 under the intermediate part 3 can be utilized for storing all kinds of things, such as spatulas, fillers, colorants, directions for use, etc.

As described hereinbefore, closure of an opened package can be done by clamping the open side of the package between the two supporting surface parts. Now, this can be realized in many ways, as will be explained below in more detail, if not exhaustively, with reference to FIGS. 5–10.

FIG. 5, as do FIGS. 6–10, highly diagrammatically shows a first supporting surface part 31 and a second supporting surface part 32, on which an opened package 33 is disposed.

Figure 6:
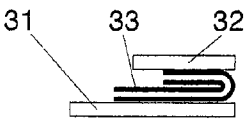

In the embodiment of FIG. 6, a closure of the package 33 is effected by pivoting the second supporting surface part 32 upwards about an axis located in the vicinity of the transition between the first and the second supporting surface part, so that the part of the package 33 projecting relative to the first supporting surface part 31 is folded back and folded over, face-to-face clamping between the two supporting surface parts providing the closure.

Figure 7:
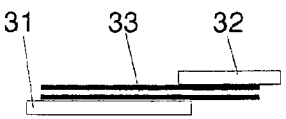

In the embodiment of FIG. 7, the second supporting surface part 32 has been pivoted around an axis located approximately in the middle thereof from under the package into a position located on top thereof, the package being squeezed and closed by edgewise cooperation of the two supporting surface parts. This is a closure as obtained with the embodiment shown in FIGS. 1–4.

Figure 8:
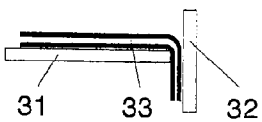

In the embodiment of FIG. 8, the second supporting surface part 32 has been placed, in an orientation upstanding to a greater or lesser extent, so as to press against the front edge of the first supporting surface part 31 whilst confining and squeezing shut the package 33.

Figure 9:
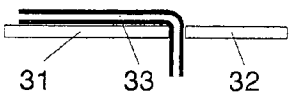

In the embodiment of FIG. 9, the second supporting surface part 32, inverted or not, has been pulled from under the package 33, after which the part of the package 33 projecting relative to the first supporting surface part has come to hang in a downward position, automatically by gravity or not, and is then clamped between the front edges of the two supporting surface parts.

Figure 10:
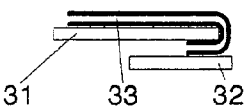

In the embodiment of FIG. 10, compared to that of FIG. 9, the downwardly hanging part of the package 33 has been brought by the second supporting surface part 32 into a position folded around the edge of the first supporting surface part 31 and closed off by squeezing against the underside of the first supporting surface part 31.

It is self-explanatory that, within the scope of the invention as laid down in the appended claims, many other modifications and variants are possible. Thus, the second supporting surface part, that is, in FIGS. 1–4 the plate-shaped flange 14, need not be integrally formed with a cover part, but may also be arranged so as to be movable relative to the first supporting surface part, the plate-shaped part 10, in a different way. To be considered here is, for instance, hingedly or detachably fitting the second supporting surface part in the bottom part and/or to the first supporting surface part. The first supporting surface part need not be of removable design, but may also be hingedly or fixedly connected with the bottom part, in which latter case a hinged part may be arranged in the bottom surface of the bottom part to allow access to the space, if present, below the first supporting surface part. The spatula may, if desired, be provided with supplementary coupling or guiding means with the apparatus, such as cooperating ribs and grooves. Instead of a spatula, a different metering control means may be selected, for instance a roller connected or not connected with the apparatus. The package may be arrested in the apparatus in many ways other than with lugs, for instance with clamping strips and clamping slots. Although this is preferred, the apparatus need not be of box-shaped design, and a cover part and/or bottom part may be absent. Essential is that the supporting surface is made of two-part design, such that it can carry the complete package up to and including the dispense opening or dispense openings thereof, so that the package can be emptied completely, and that by cooperation of the first and the second supporting surface part an opened package can be closed.

The invention claimed is:

1. An assembly provided with a package and an apparatus for the metered emptying of the package, which package contains viscous material and is at least partly manufactured from flexible sheet-like foil material, and which apparatus is provided with a frame with guide means and a substantially flat supporting surface for supporting the package, as well as with metering control means which, guided by the guiding means, can be moved, in a position substantially not changing as regards their orientation relative to the supporting surface, over and along the supporting surface, the emptying taking place by nipwise squeezing the package flat onto the supporting surface with the metering control means, starting from a first end in the direction of a second end, located opposite the first end, with at least one dispense opening to be opened by cutting away material of the package, the at least one dispense opening being situated on the supporting surface, and the metering control means being movable over the supporting surface as far as the at least one dispense opening, characterized in that the frame comprises a stationary part having a first supporting surface part and a part movable relative to the stationary part, having a second supporting surface part, wherein a first position, in which the movable part is coupled with the stationary part, the second supporting surface part is in line with and contiguous to the first supporting surface part and carries a part of the package including the at least one dispense opening, while in a second position, in which the movable part is also coupled with the stationary part, the second supporting surface part is offset relative to the first supporting surface part, the arrangement being such that in the second position, through a cooperation, secured against movement, of the stationary part and the movable part, the package is substantially sealingly closed off in the vicinity of the at least one dispense opening.

2. An assembly according to claim 1, characterized in that the second supporting surface part in the second position extends substantially parallel to the first supporting surface part.

3. An assembly according to claim 2, characterized in that the movable part can be brought from the first position into the second position by pivoting relative to the stationary part, the arrangement being such that in the second position the second supporting surface is directed substantially opposite to the first supporting part.

4. An assembly according to claim 3, characterized in that in the second position a free end edge of the movable part leading in the first position lies against an end edge of the stationary part leading both in the first and in the second position, thereby clamping and closing off a part of the package.

5. An assembly according to claim 4, characterized in that an edge area of the second supporting surface part on the movable part in the second position is situated opposite an edge area of the first supporting surface part on the stationary part.

6. An assembly according to claim 1, characterized in that the movable part forms part of a cover part and the stationary part forms part of a bottom part, while in the second position of the supporting surface parts the cover part and the bottom part form a closed box in which the package is contained.

7. An assembly according to claim 6, characterized in that, viewed in the first position of the supporting surface parts, the cover part, contiguous to a side of the second supporting surface part remote from the first supporting surface part, forms a mixing part for material pressed out of the package, while the cover part in that position can be uncoupled from the bottom part.

8. An assembly according to claim 1, characterized in that on the first supporting surface part, viewed in the first position of the supporting surface parts, on a side remote from the second supporting surface part, fixing means are provided for fixing the package relative to the first supporting surface part.

9. An assembly according to claim 1, characterized in that the guide means, viewed in the first position of the supporting surface parts, have the form of raised side edges located in line with each other on both sides of the first and the second supporting surface part, and the metering control means have the form of a spatula-like member having such a width that the spatula-like member can be slid between the raised side edges with a sliding fit.

10. An apparatus for the metered emptying of a package containing viscous material and at least partly manufactured from flexible sheet-like foil material, which apparatus is provided with a frame with guide means and a substantially flat supporting surface as well as with metering control means, the metering control means and the guide means being arranged such that the metering control means can be moved, in a position not changing as regards their orientation relative to the supporting surface, over and along the supporting surface, characterized in that the frame comprises a stationary part having a first supporting surface part and a part movable with respect to the stationary part, having a second supporting surface part, wherein in a first position, in which the movable part is coupled with the stationary part, the second supporting surface part is in line with and contiguous to the first supporting surface part, and in a second position, in which the movable part is also coupled with the stationary part, the second supporting surface part, while leaving clear a relatively narrow slit in the order of the thickness of two layers of flexible sheet-like foil material, is offset and secured with respect to the first supporting surface part.

11. An apparatus according to claim 10, characterized in that the stationary part is accommodated in a bottom part and the movable part is accommodated in a cover part, while the bottom part and the cover part can be assembled to form a closed box in which the two supporting surface parts are in the second position, while in an open position of the box the bottom part and the cover part can be brought into a coupled position such that the two supporting surface parts are in the first position.

12. An apparatus according to claim 11, characterized in that the second supporting surface part is provided on an end of the cover part which, at least in the closed position of the box, is connected by means of a hinge connection with an end of the bottom part.

13. An apparatus according to claim 12, characterized in that in the closed position of the box the ends of the bottom part and the cover located opposite the hingedly connected ends of those parts are connected by a childproof closure.

14. An apparatus according to claim 12, characterized in that the hinge connection is formed by journals on one part and recesses receiving these in the other part, the arrangement being such that in the said open position of the box the hinge connection can be undone.

15. An apparatus according to claim 14, characterized in that the cover part, on both sides of the second supporting surface part, is provided with side wall flanges extending perpendicularly to the second supporting surface part, and the bottom part is provided with side wall parts extending in line with the first supporting surface part and perpendicularly thereto, the side wall flanges being provided with said recesses and the side wall parts being provided with said journals, the arrangement being such that in the second position of the supporting surface parts the side wall flanges and the side wall parts are situated next to each other face-to-face and the journals sit in the recesses, while in the first position of the supporting surface parts the journals are detachably located in the recesses.

16. An apparatus according to claim 15, characterized in that the side wall flanges are each provided with a recess in the form of half a slotted-hole opening with an open outer end and a semi-circular inner end, the arrangement being such that the journals in the first position of the supporting surface parts can slide into and out of the open outer end and in the second position of the supporting surface parts butt against the semi-circular inner end.

17. An apparatus according to claim 16, characterized in that each side wall flange, starting from the semi-circular inner end of the half slotted-hole opening, in a direction away from the open inner end of the half slotted-hole opening, is provided with a snap-in recess.

18. An apparatus according to claim 11, characterized in that the cover part, viewed in the first position of the supporting surface parts, contiguous to the second supporting surface part, has the form of an open tray.

19. An apparatus according to claim 18, characterized in that the open tray is divided into two compartments by a transverse partition.

20. An apparatus according to claim 10, characterized in that the first supporting surface part is situated on an intermediate part accommodated in the bottom part.

21. An apparatus according to claim 10, characterized in that the first supporting surface part is provided on both sides with side edges extending perpendicular thereto, which can serve as guide means and, in the first position of the supporting surface parts, are in line with side wall flanges arranged on both sides of the second supporting surface part, while, further, metering control means are provided in the form of a spatula-like member, having a width substantially equal to the distance between the side edges on opposite sides of the first supporting surface part, and which is provided with a rounded bent emptying edge having on both sides guide surfaces extending perpendicular thereto.

22. An apparatus according to claim 10, characterized in that on the first supporting surface part, in an end area remote from an area contiguous to the second supporting surface part in the first position of the supporting surface parts, fixing means for a package are provided.

23. An apparatus according to claim 22, characterized in that the fixing means are formed by a clamping strip or clamping slot.

24. An apparatus according to claim 22, characterized in that the fixing means consist of hooking lugs with a hooking direction substantially parallel to the first supporting surface part, which hooking lugs are suitable for cooperating with openings provided in a package.

* * * * *